US009516947B2

(12) United States Patent
Taylor

(10) Patent No.: US 9,516,947 B2
(45) Date of Patent: Dec. 13, 2016

(54) LADDER CHAIR

(71) Applicant: Alex Taylor, Arlington, VA (US)

(72) Inventor: Alex Taylor, Arlington, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 14/707,976

(22) Filed: May 8, 2015

(65) Prior Publication Data

US 2015/0320218 A1 Nov. 12, 2015

Related U.S. Application Data

(60) Provisional application No. 61/990,316, filed on May 8, 2014.

(51) Int. Cl.

| | |
|---|---|
| ***A47C 4/00*** | (2006.01) |
| ***A47C 7/02*** | (2006.01) |
| ***A47B 85/06*** | (2006.01) |
| ***A47C 4/04*** | (2006.01) |
| ***A47C 1/14*** | (2006.01) |
| ***A47C 13/00*** | (2006.01) |

(52) U.S. Cl.

CPC ..... *A47B 85/06* (2013.01); *A47C 1/146* (2013.01); *A47C 4/04* (2013.01); *A47C 13/00* (2013.01)

(58) Field of Classification Search

CPC ..... A47C 4/04; A47C 1/146; A47C 13/00; A47B 85/06

USPC ..... 297/42, 43, 44, 45, 440.12, 16.1, 16.2,297/17, 440.14, 440.1

See application file for complete search history.

(56) References Cited

U.S. PATENT DOCUMENTS

| | | | | | |
|---|---|---|---|---|---|
| 70,339 | A | * | 10/1867 | Kreitz | A47B 19/06 108/9 |
| 1,134,057 | A | * | 3/1915 | Neff | A47C 9/105 108/128 |
| 1,215,689 | A | * | 2/1917 | Neff | A47B 3/02 108/128 |
| 1,580,557 | A | * | 4/1926 | McGrew | A47C 4/283 297/45 |
| 1,963,835 | A | * | 6/1934 | Deland | A47C 9/10 297/44 |
| 2,822,860 | A | * | 2/1958 | Calabrese | A47C 5/005 297/440.12 X |
| 4,025,106 | A | * | 5/1977 | Kyte | A47D 1/02 297/440.12 X |
| 4,533,179 | A | * | 8/1985 | Nichols | A47C 4/08 297/440.12 X |
| 5,078,056 | A | * | 1/1992 | McCauley | A47B 3/00 108/115 |

(Continued)

FOREIGN PATENT DOCUMENTS

| | | | | |
|---|---|---|---|---|
| AT | 12204 U1 | * | 1/2012 | A47B 43/00 |
| FR | 582616 A | * | 12/1924 | A47C 4/04 |

(Continued)

*Primary Examiner* — Rodney B White

(74) *Attorney, Agent, or Firm* — Keith A. Vogt; Vogt IP

(57) ABSTRACT

A configurable furniture system and method are disclosed. The system and method include one or more panels, each of the panels having one or more working edges. One or more hinges successively connect the panels together at the working edges. The system is able to convert from a folded configuration into a functional configuration, which may be a chair, desk, lounge, table or stool.

14 Claims, 8 Drawing Sheets

(56) References Cited

U.S. PATENT DOCUMENTS

| | | | | | |
|---|---|---|---|---|---|
| 5,913,571 | A * | 6/1999 | Dystra | A47C 17/22 | 297/440.12 X |
| 5,979,976 | A * | 11/1999 | Ferencik | A47C 4/04 | 297/16.1 X |
| 6,079,772 | A * | 6/2000 | Green | A47C 4/08 | 297/440.12 X |
| 7,048,331 | B2 * | 5/2006 | Saakyan | A47C 4/283 | 297/45 X |
| 7,552,733 | B1 * | 6/2009 | Schubert, III | A47C 16/00 | 128/845 |
| 7,794,019 | B2 * | 9/2010 | Hoberman | A47B 3/087 | 297/440.12 X |
| 8,136,873 | B2 * | 3/2012 | Fritsch | A47C 4/283 | 297/42 X |
| 8,684,466 | B2 * | 4/2014 | Blair | A47C 13/005 | 297/440.1 |
| 8,701,830 | B2 * | 4/2014 | Merey | E06C 1/26 | 108/92 |

FOREIGN PATENT DOCUMENTS

| | | | | |
|---|---|---|---|---|
| FR | 2790928 | A1 * | 9/2000 | A47C 4/04 |
| FR | 2839627 | A1 * | 11/2003 | A47C 4/04 |

* cited by examiner

LADDER CHAIR

RELATED APPLICATIONS

This application claims the benefit of U.S. Provisional Application No. 61/990,316 filed May 8, 2014 and herein incorporated by reference.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

Furniture, such as chairs, tables and stools are typically constructed in different physical arrangements to serve different functions. In certain situations, such as where space is limited, it may be desirable to have a piece of furniture function in multiple configurations to perform multiple tasks. In addition, there is a need for a reconfigurable furniture device that is compact, portable and easy to use.

Therefore, there is a need for a device that allows reconfiguration of furniture to operate in multiple functional modes while maintaining the ability to take on a compact form when not in use. The present invention provides this, and other advantages, as will be apparent from the following detailed description and accompanying figures.

BRIEF SUMMARY OF THE INVENTION

In one embodiment, the present invention provides a portable furniture piece that may be configured into multiple arrangements by transitioning or converting from a compact configuration into a chair, lounge, table, desk or stool. In the compact configuration, in one embodiment, the device is in the form of a flat package. As a flat package, the present invention is easily carried and, thus, may be used indoors and outdoors.

In another embodiment, the present invention provides a series of panels that are interconnected in succession, such as by hinges that permit the panels to be folded onto one another and positioned into a variety of configurations.

In yet another embodiment, the present invention provides a series of seven flat panels that are woven together in succession with flexible webbing material. The weave of the material around the panels is similar to that of a Jacob's Ladder. The interconnection permits the panels to be folded onto one another and to be positioned into a variety of configurations.

In still further embodiments, the panels of the present invention may include a plurality of slots in the panels that allow a second webbing material to snake through the panels and secure the panels in a desired configuration. A key may be used to tighten down the structure.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1A:
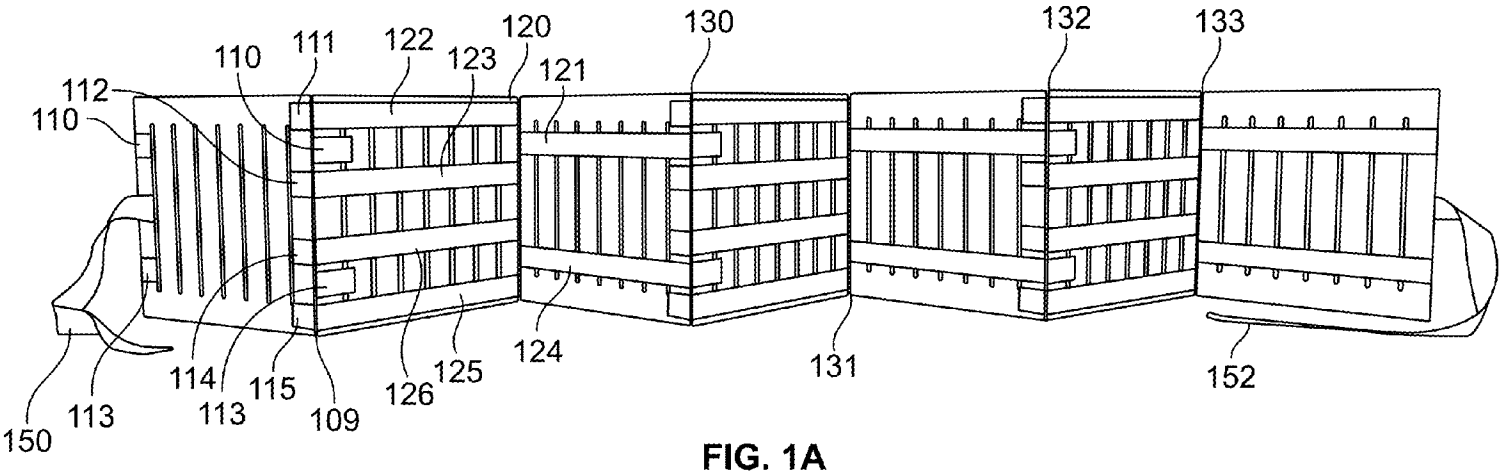
FIG. 1A shows a top view of one embodiment of the present invention.
Figure 1B:
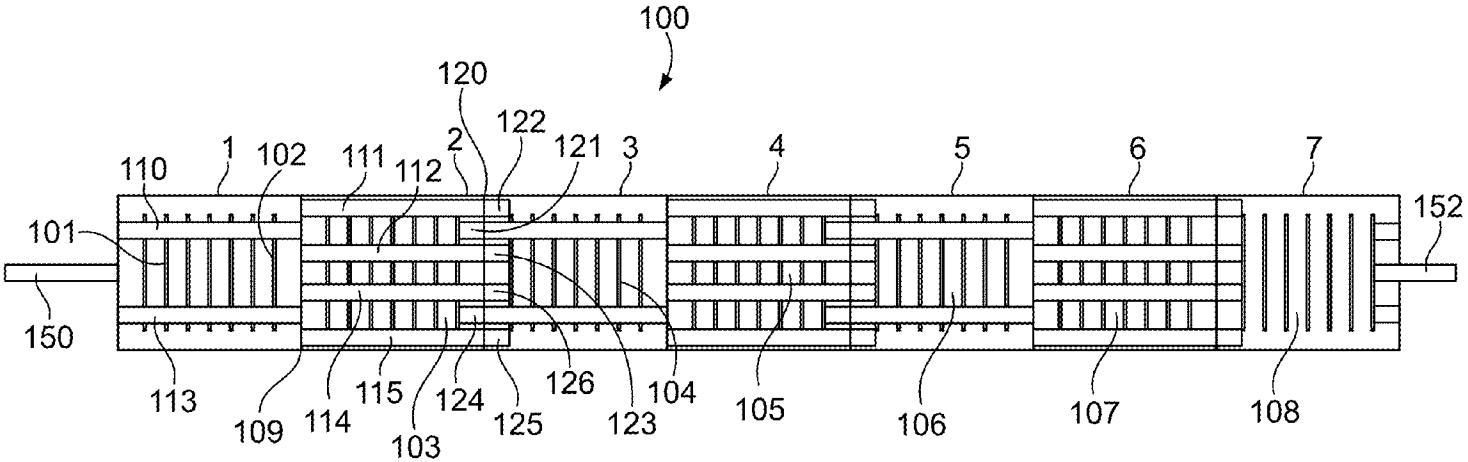
FIG. 1B shows a bottom view of the embodiment shown in FIG. 1A.

In one preferred embodiment, as shown in FIGS. 1A and 1B, the present invention provides a plurality of panels 1-7 that may be rectangular or square in configuration. The panels may be made of any desired material that has a degree of rigidity such wood, plastic, or fiberglass and the like.

In other embodiments, panels 1-7 may be identical panels that are 17.5"×19"×⅜"7-ply Baltic Birch plywood. The plywood is finished with a water-based flat clear coat to resist water and to feel smooth to the touch. Other materials that may be used in lieu of plywood are plastic, carbon fiber, fiber glass, or other species of wood. The panel dimensions as well as the cut out placements of each panel may vary. The finish for the panels may also vary and could be painted or stained.

When combined together, the panels may be configurable into a variety of furniture designs. More particularly, as will be shown below, the panels may be transitioned or converted from a portable compact design to one or more functional configurations such as a chair, lounge, desk or stool as well as many other functional configurations. In addition, the panels may be converted from any other design into another design, i.e., from a chair to a desk.

As shown in FIGS. 1A and 1B, each of the panels contain a plurality of spaced apart slots 101-108 with a portion of the slots running down the centerline of the panels. As shown in FIGS. 1A and 1B and 2A-2C, a Jacob's Ladder flipping hinge arrangement generally comprises a first strap which has a first end connected to a first panel and a second end connected to a second panel wherein the first strap wraps around an exterior side of the second panel, and a second strap which has a first end connected to the second panel and a second end connected to the first panel wherein the second strap wraps around an exterior side of the first panel. This forms two spaced hinges at opposite ends of the first and second panels. The hinge movement will be further explained in the description below. A third strap may be provided to provide a hinge with less flexibility or play in the non-hinging-axis of the configuration. More than three straps may also be provided as described below.

As shown in FIGS. 1A and 1B and 2A-2C, in a preferred embodiment, panels 1-7 may be interconnected by flipping hinges that may be in the form of a Jacob's ladder. As further shown, a repeatable hinge design that may be used with a preferred embodiment involves three straps 110-112, which may be of equal length and made of a flexible material such as nylon. Strap 110 is affixed to an edge of panel 1 and transverses across panel 1 to panel 2 where it is affixed to an opposing edge of panel 2. Panel 2, in turn, has straps 111 and 112 that transverse across panel 2 to panel 1 where they are affixed to an opposing edge of panel 1. As shown in FIGS. 1A and 1B, straps 113-115 repeat this pattern to form hinge 109. While six straps are shown in total, the three-strap configuration of straps 110-112 may be used as well. To form hinge 120, straps 121-126 are configured as described above. In addition, as shown in FIGS. 1A-1B, hinges 130-133 may also be configured as described above. In addition, locking straps 150 and 152 may be provided on the outer edges of panels 1 and 7, respectively.

Figure 2A:
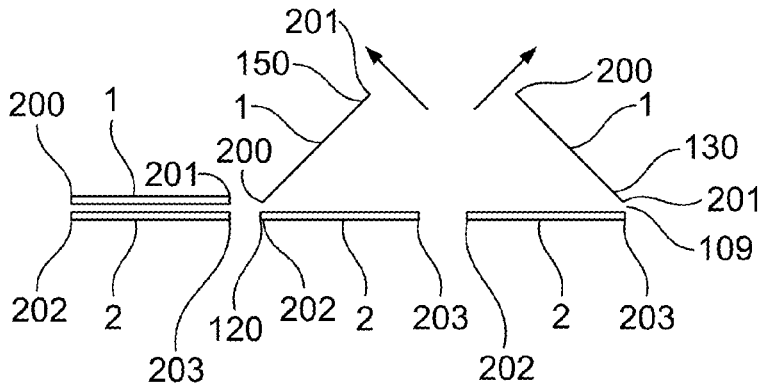
FIGS. 2A-2C illustrate a dual-sided hinge that may be used with an embodiment of the present invention.
Figure 2B:
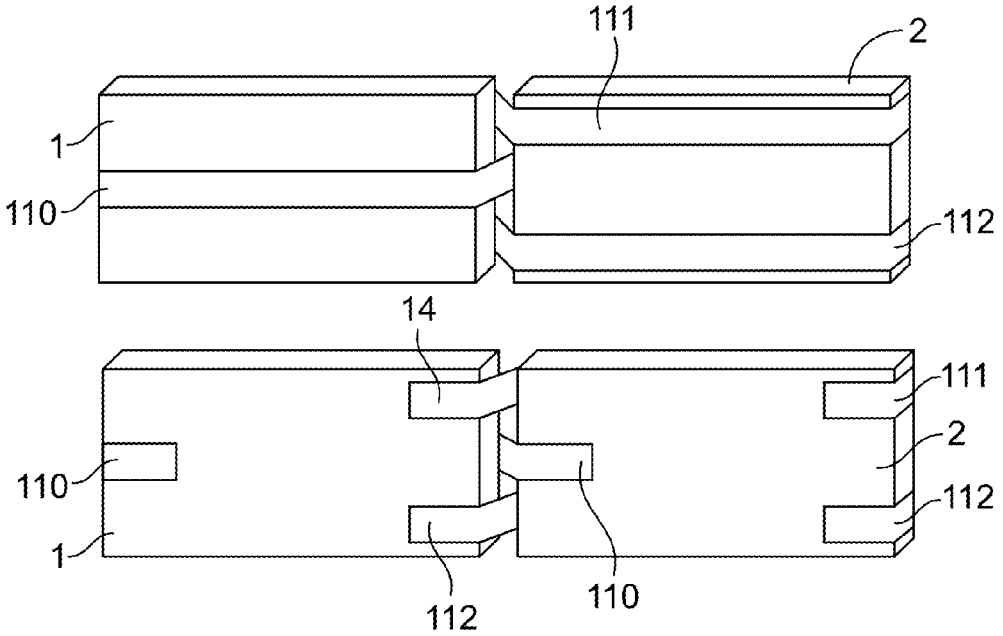
Figure 2C:
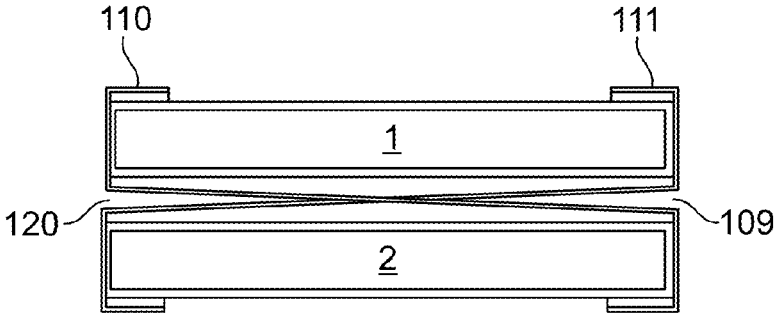
Figure 3:
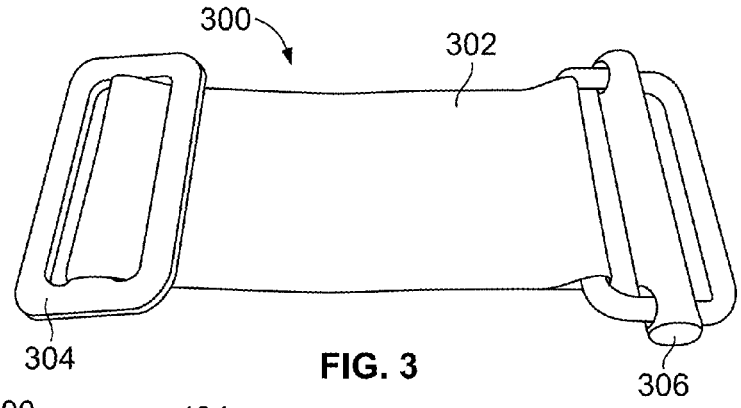
FIG. 3 depicts a key used with one embodiment of the present invention.

As illustrated in FIG. 2A, using the above described hinges permit opposing or working edges 200-203 of panels 1 and 2 to be hinged to each corresponding edge of its successive panel. As shown, edge 200 of panel 1 may be both hinged to and movable with respect to edge 202 of panel 2 as a result of the construction of hinge 109. Edge 201 of panel 1 may also be hinged to and movable with respect to edge 203 of panel 2 as a result of hinge 120. In addition, working edges 202-203, as well as the other working edges on other panels, may be similarly hinged together and operate as described. In operation, each panel is connected to the adjacent panel by a Jacob's Ladder flipping hinge arrangement which depends on the arrangement of interlaced ribbons disclosed above. This arrangement allows each panel to act as if hinged to the next one at either of its two working ends.

The straps or webbing that may be used include a 2-inch wide black polypropylene seatbelt material. In other embodiments, other strap or webbing material that may be used include leather, cotton, or other plastic material. The width of the webbing may be less than or more than 2 inches.

Each respective panel may deploy this dual hinged design with respect to its successive panel. As a result, the panels can fold onto one another and be positioned into a variety of configurations. However, mechanical hinges may be used as well. Their use, however, limits the number of configurations that may be obtained.

As shown in FIGS. 3 and 4A-4C, the panels are locked or tightened together by locking mechanism 300. In a preferred embodiment, locking mechanism 300 is a key that interacts with locking straps 150 and 152. Key 300 is comprised of a steel 3-bar slider 304 connected to an adjustable slider 306 with webbing material. In a preferred embodiment, two keys are used to maintain the rigidity of the desired configuration. In addition, other tensioning mechanisms known to those of skill in the art may be used as well.

Figure 4A:
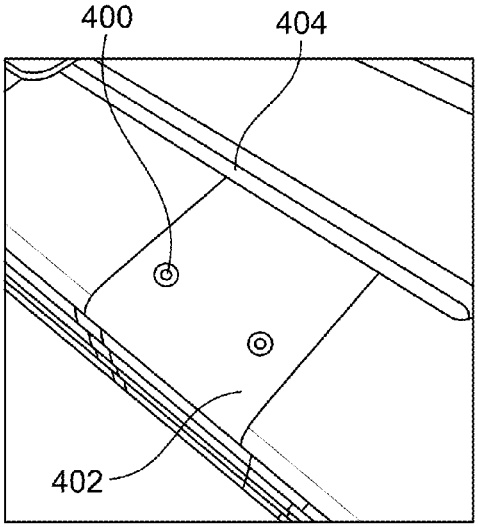
FIGS. 4A-4C show how a key and strapping may be used with an embodiment of the invention.

As shown in FIG. 4A one or more rivets 400 or, some other suitable fasteners, may be used to fasten the straps or webbing to the panels. Other suitable methods of fastening the webbing to the panels may include glue or welding.

Figure 4B:
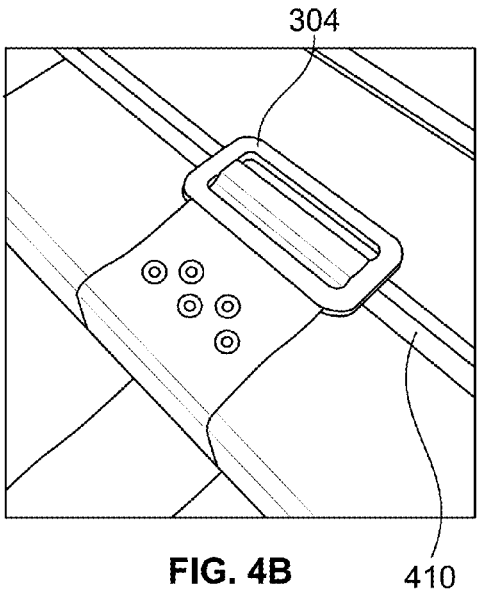
Figure 4C:
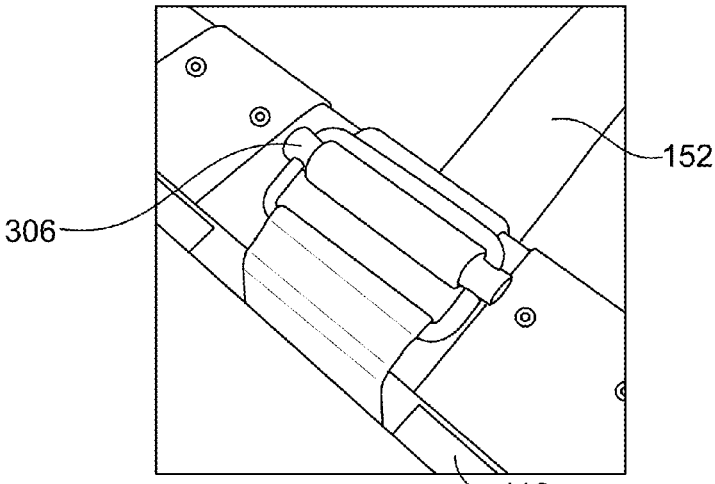

In operation, as shown in FIG. 4B, slider 304 is slipped through slot 410. Strap 152 is then threaded through slider 306 and pulled to create a binding force that is exerted on the panels. Straps 150 and 152 may be snaked through a plurality of panels to tighten down the configured structure.

Figure 5:
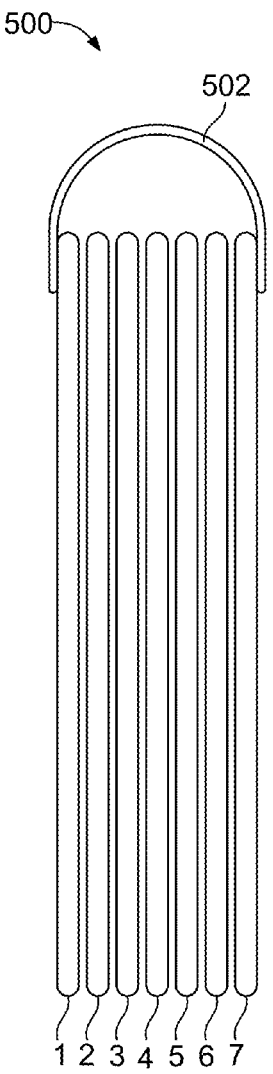
FIG. 5 shows an embodiment of the present invention configured in a compact, flat panel configuration or folded configuration for storage and carrying.

FIG. 5 shows an embodiment of the present invention in a flat, stacked configuration 500. Handle 502 is provided to assist in transporting the panels. This configuration is used for transportation and storage. The piece is capable of folding into a flat package that can be easily toted around and stowed. Two locking mechanisms or keys may be used to lock the panels together by passing through the slots of each panel, and also to form handle 502 for carrying.

Figure 6A:
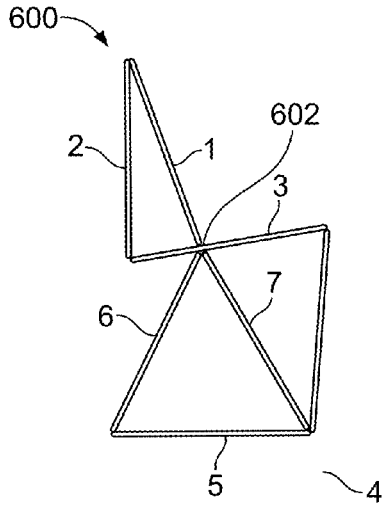
FIGS. 6A-6C illustrate how an embodiment of the present invention may be configured as a chair.
Figure 6B:
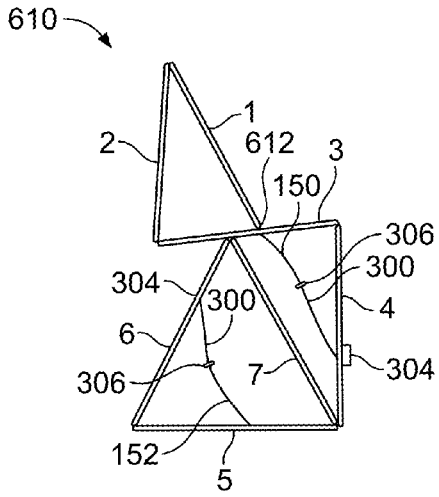
Figure 6C:
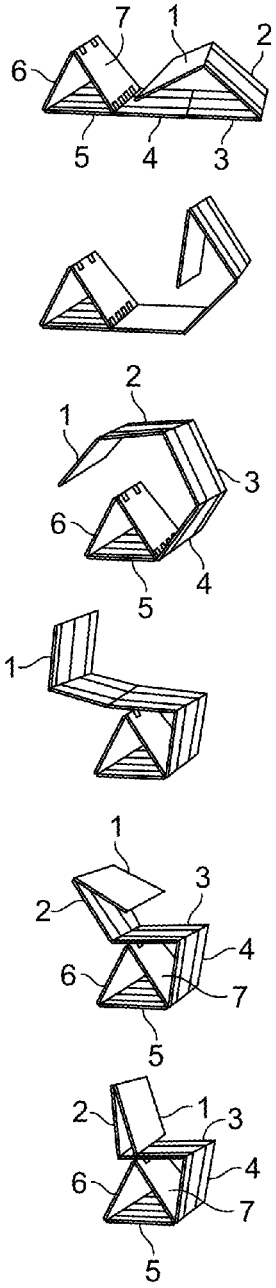

As shown in FIGS. 6A-6C, the present invention may transition or convert from a stack design 500 into a chair design 600. As shown, panels 5-7 form the base of the chair and panels 1-4 form the other components of the chair. Specifically, panel 3 forms the seat and panels 1 and 2 form the backrest. In addition, this configuration allows the user to sit upright with the feet flat to the floor. This configuration may also be adjusted to angle back or move forward depending on which slots are used to secure the structure as demonstrated by the different connection points 602 and 612.

FIG. 6B depicts potential locations to lock or tighten chair assembly 610. As shown, two keys are used to create tension between the panels through interaction with straps 150 and 152. In operation, straps are inserted through a desired slot and the keys are inserted through a desired slot. The straps are threaded through buckle 306 and pulled to tighten the assembly. As indicated above, buckle 304 prevents the key from slipping through a slot.

FIG. 6C depicts how each successive panel may be flipped away from each adjoining panel to convert the panels from the folded, stacked panel configuration 500 to chair 600. In operation, the seven panels, which may be connected by flipping hinges, initially start in folded configuration 500 and then are configured into a desired functional form. In a preferred embodiment, chair 600 is comprised of three connected triangles with the first defined by panels 5, 6, and 7, the second defined by panels 3, 4 and 7, and the third defined by panels 1, 2, and 3.

FIG. 6C illustrates one of the many operational modes of the invention. As shown, the reconfiguration method may start with an end panel, such as panel 1 which is flipped away from panel 2 into a first desired position. Panel 2 is then flipped away from panel 3 into a second desired position. Panel 3 is then flipped away from panel 4 into a third desired position. Panel 4 is then flipped away from panel 5 into a fourth desired position. Panel 5 is then flipped away from panel 6 into a sixth desired position. Panel 6 is then flipped away from panel 7 into a seventh desired position. Next, locking mechanisms are used to bind the arrangement together.

Figure 7A:
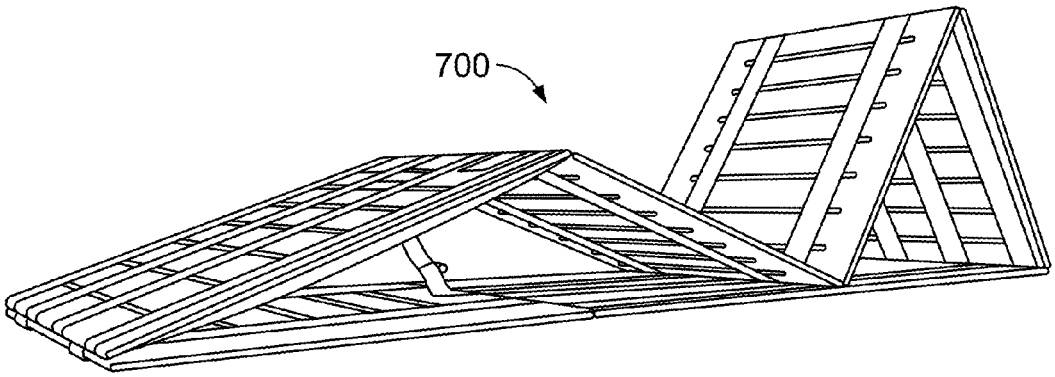
FIGS. 7A-7C illustrate how an embodiment of the present invention may be configured as a lounge.
Figure 7B:
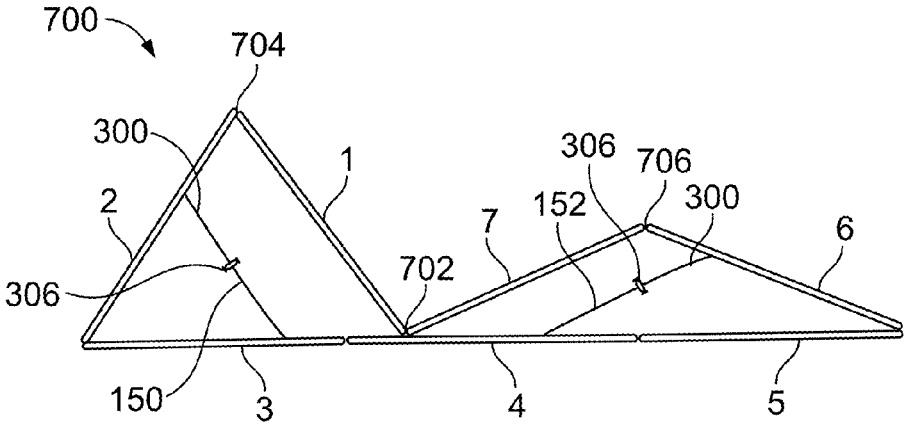
Figure 7C:
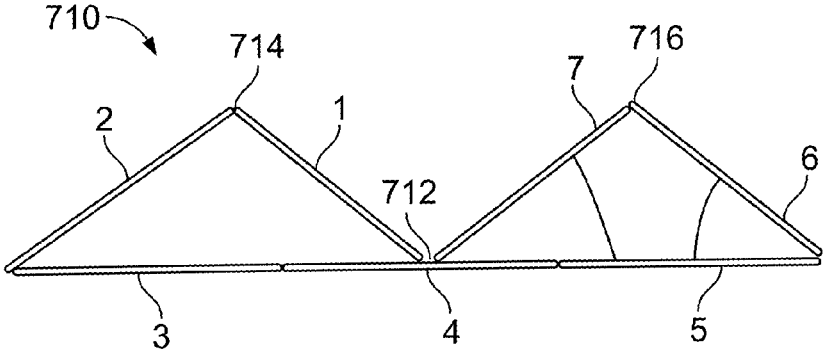

FIGS. 7A-7C illustrate how panels 1-7 may be configured into an adjustable lounge 700 and 710. This configuration allows the user to lay back and stay elevated above the ground. This configuration may also be adjusted to angle the user's view forward and lower the legs, or to angle the user's view upwards and elevate the legs. The adjustability of the design is shown by the different locations in which connection points 702 and 712 are located on panel 4 as shown in FIGS. 7B and 7C. Again, these different variations depend on the slots used to secure the structure and the location of the locking straps and locking mechanisms. In a preferred embodiment, panels 3-5 form the base, panels 1-2 form the backrest, and panels 6-7 form the footrest. As also illustrated, in a preferred embodiment, arranging the panels into two connected triangles with the first defined by panels 1-4 and the second defined by panels 4-7 forms lounge 700.

Figure 8A:
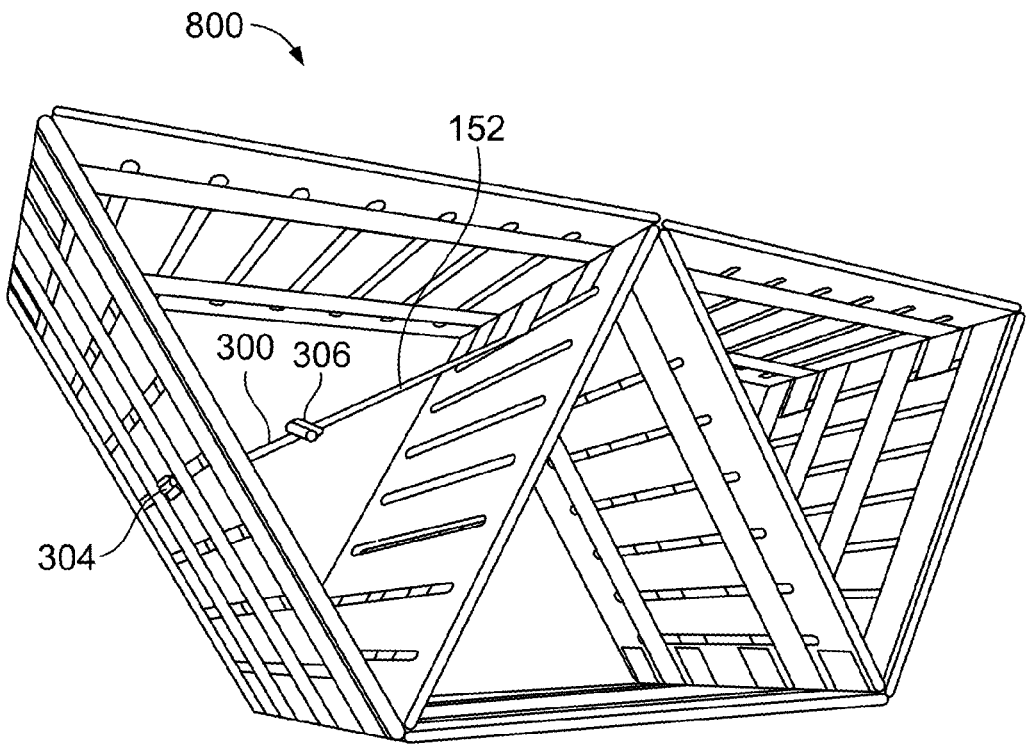
FIGS. 8A-8B illustrate how an embodiment of the present invention may be configured as a table.
Figure 8B:
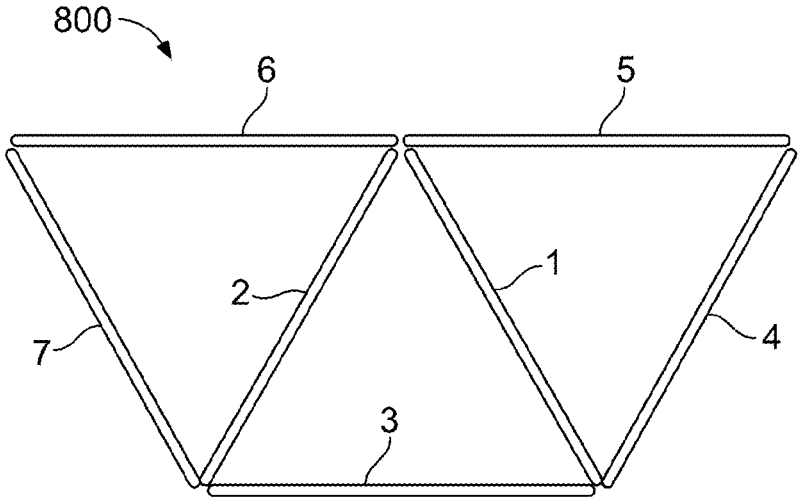

FIGS. 8A and 8B illustrate how panels 1-7 may be configured into a table 800. Panel 3 provides the base, panels 1, 2, 4, and 7 provide the sides and panels 5 and 6 function as the top. In a preferred embodiment, table 800 is formed by arranging the panels into three connected triangles with the first defined by panels 1, 2, 3, the second defined by panels 1, 4, 5, and the third defined by panels 2, 6, and 7.

Figure 9A:
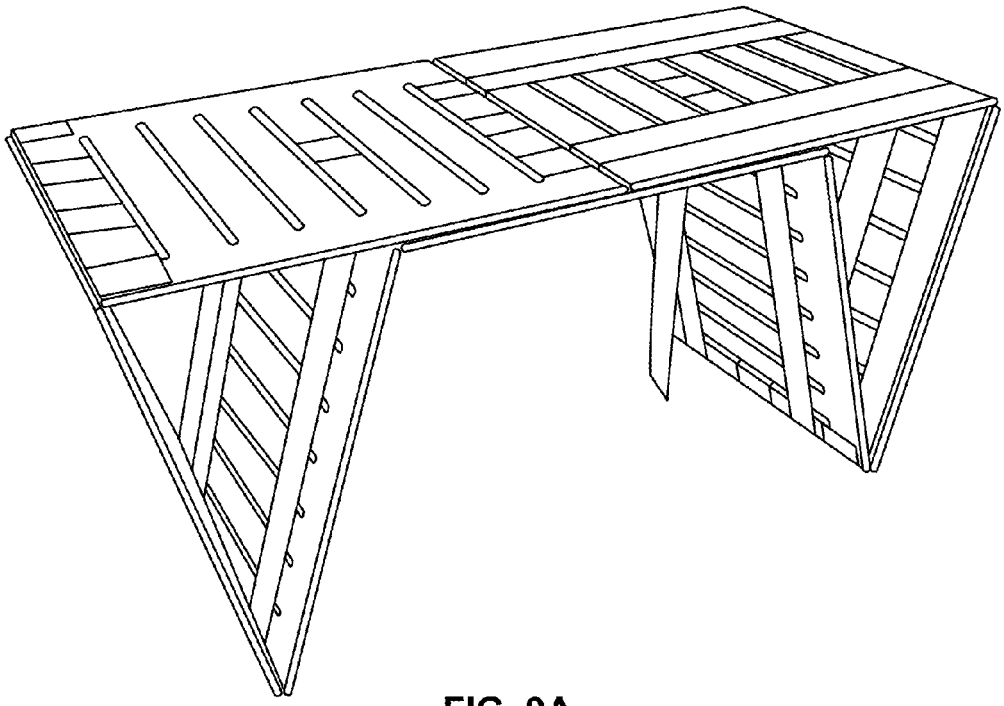
FIGS. 9A-9B illustrate how an embodiment of the present invention may be configured as a desk.
Figure 9B:
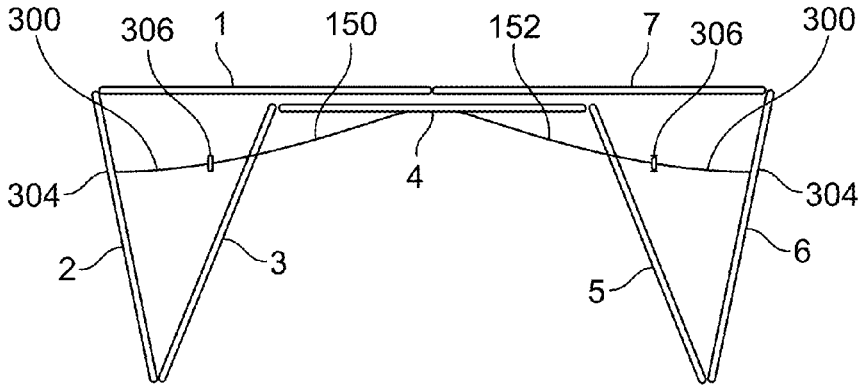

FIGS. 9A and 9B illustrate how panels 1-7 may be configured into a desk 900. As shown, panels 2-3 and 5-6 form the bases and panels 1, 4 and 7 form the desktop. Locking mechanism 300 and straps interact to secure the arrangement. Desk 900 may be formed by arranging the panels into two opposingly located triangles (panels 1-3 and panels 5-7) connected by a planar surface formed by panels 1, 4 and 7.

Figure 10A:
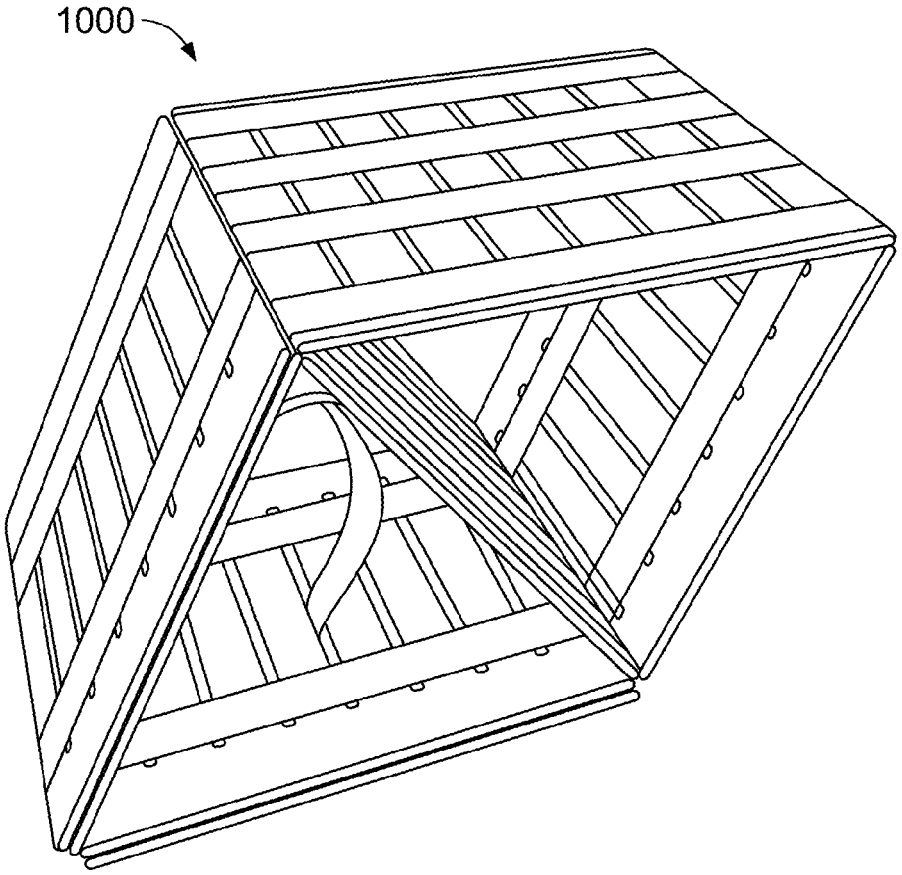
FIGS. 10A-10B illustrate how an embodiment of the present invention may be configured as a stool.
Figure 10B:
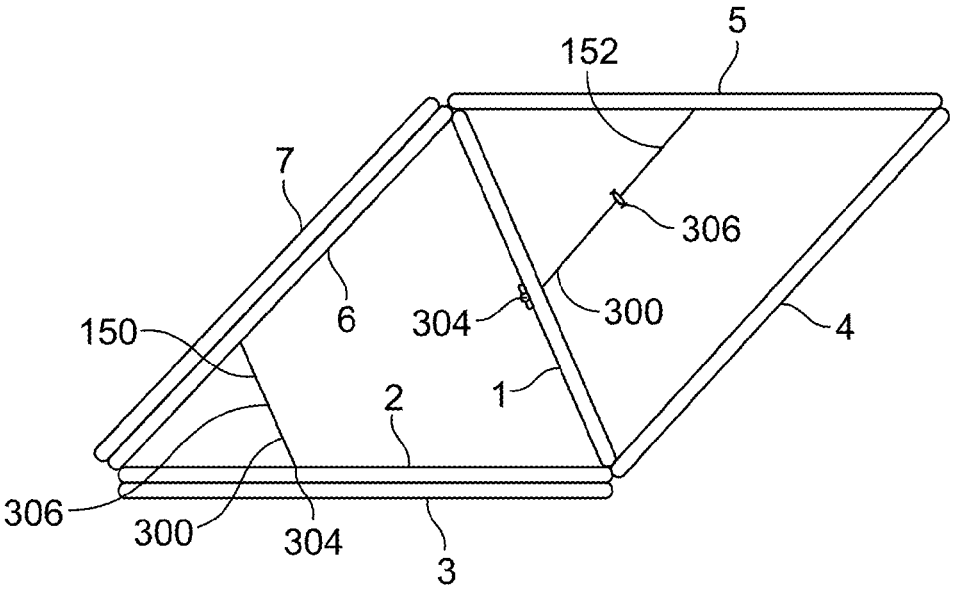

FIGS. 10A and 10B illustrate how panels 1-7 may be configured into a stool 1000. As shown, panels 2 and 3 form the base and panels 1, 4-7 form the remainder of the stool. Locking mechanism 300 and straps interact to secure the arrangement. Stool 1000 may be formed by arranging the panels into a quadrilateral.

While in a preferred embodiment the present invention provides a multi-functional, reconfigurable furniture system having seven panels, other embodiments provide different numbers of panels. For example, in other embodiments, the furniture system may deploy 3-6 panels and in other embodiments the system may deploy 8 or more panels.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A multi-functional, convertible furniture system comprising:

a plurality of panels, each of said panels having a first working edge and an opposingly located second working edge;

two adjacent panels connected by at least a first strap and a second strap, the first and second straps being spaced apart, each of said straps having an end connected to a first working edge of one panel and an opposing end of said strap connected to the second working edge of the other adjacent panel;

a third strap interlaced between said spaced apart first and second straps, said third strap having an end connected to a first working edge of one panel and an opposing end of said strap connected to the second working edge of the other adjacent panel;

said interlaced first, second, and third straps permitting adjacent panels to act as if hinged to one another at either said first or said second working edges; and said panels adapted to be converted from a folded configuration to a functional configuration.

2. The system of claim 1 further including a plurality of slots in said panels sized to releaseably engage at least one locking mechanism that rigidly connects the panels together.

3. The system of claim 2 wherein said plurality of panels is comprised of seven panels.

4. The system of claim 3 wherein said functional configuration is a chair.

5. The system of claim 3 wherein said functional configuration is a lounge.

6. The system of claim 3 wherein said functional configuration is a desk.

7. The system of claim 3 wherein said functional configuration is a table.

8. The system of claim 3 wherein said functional configuration is a stool.

9. A multi-functional, convertible furniture system comprising:

seven panels, each of said panels having; a first working edge and an opposingly located second working edge;

two adjacent panels connected by at least a first strap and a second strap, the first and second straps being spaced apart, each of said straps having an end connected to a first working edge of one panel and an opposing end of said strap connected to the second working edge of the other adjacent panel;

a third strap interlaced between said spaced apart first and second straps, said third strap having an end connected to a first working edge of one panel and an opposing end of said strap connected to the second working edge of the other adjacent panel;

said interlaced first, second, and third straps permitting adjacent panels to act as if hinged to one another at either said first or said second working edges;

a plurality of slots in said panels sized to releasably engage at least one locking mechanism that rigidly connects the panels together; and said seven panels adapted to be converted from a folded configuration to a functional configuration.

10. The system of claim 9 wherein said functional configuration is a chair formed by arranging said panels into three connected triangles.

11. The system of claim 9 wherein said functional configuration is a lounge formed by arranging said panels into two connected triangles.

12. The system of claim 9 wherein said functional configuration is a desk formed by arranging said panels into two opposingly located triangles connected by a planar surface.

13. The system of claim 9 wherein said functional configuration is a table formed by arranging said panels into three connected triangles.

14. The system of claim 9 wherein said functional configuration is a stool formed by arranging the panels into a quadrilateral.

* * * * *